United States Patent [19]

Kretschmann et al.

[11] Patent Number: 4,940,559

[45] Date of Patent: Jul. 10, 1990

[54] PROCESS FOR THE PRODUCTION OF UNIFORM POY FILAMENTS

[75] Inventors: Bernd Kretschmann, Kronberg; Dietmar Wandel, Hanau, both of Fed. Rep. of Germany

[73] Assignee: Davy McKee Aktiengesellschaft, Frankfurt, Fed. Rep. of Germany

[21] Appl. No.: 281,636

[22] Filed: Dec. 9, 1988

[30] Foreign Application Priority Data

Jun. 11, 1988 [DE] Fed. Rep. of Germany ..... 3819913

[51] Int. Cl.[5] ..... D01D 5/12

[52] U.S. Cl. ..... 264/130; 264/210.8; 264/290.5; 264/290.7

[58] Field of Search ..... 73/862.47, 862.48; 264/130, 210.8, 290.5, 290.7

[56] References Cited

U.S. PATENT DOCUMENTS

| | | | |
|---|---|---|---|
| 3,772,872 | 11/1973 | Piazza et al. | 264/210.8 |
| 4,049,763 | 9/1977 | Mineo et al. | 264/210.8 |
| 4,446,299 | 5/1984 | Koschinek et al. | 264/103 |
| 4,517,149 | 5/1985 | Oka et al. | 264/290.5 |

*Primary Examiner*—Hubert C. Lorin

*Attorney, Agent, or Firm*—Allegretti & Witcoff, Ltd.

[57] ABSTRACT

Melt spinning method for the production of pre-oriented low-crystalline synthetic filaments which are distinguished by a high degree of uniformity and by the ability of being worked at high speeds in a friction-draw texturing process, according to which method the damping ratio of the spinning filament between the point of solidification and the winding unit, defined as the ratio of the fluctuation range of the filament tension at the beginning and at the end of the above-defined filament path is $<0.10$, and a driven roller with a freely rotating additional small roller in multiple wrap-around contact is utilized as the draw-off roller system.

7 Claims, 1 Drawing Sheet

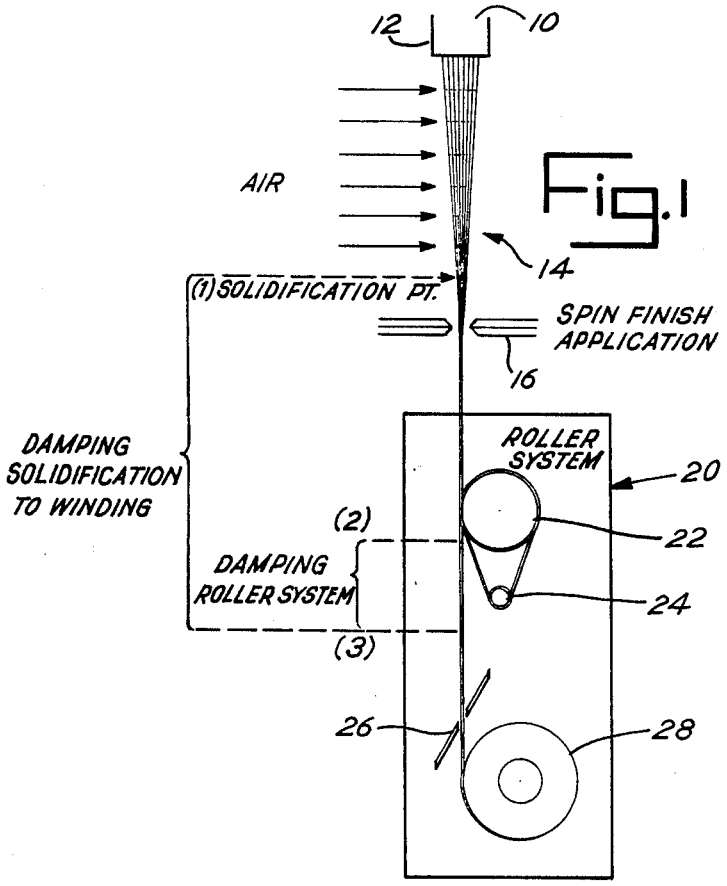
Fig. 1
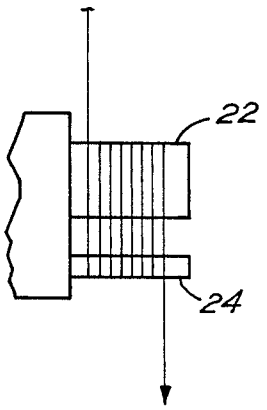
Fig. 2
Fig. 3
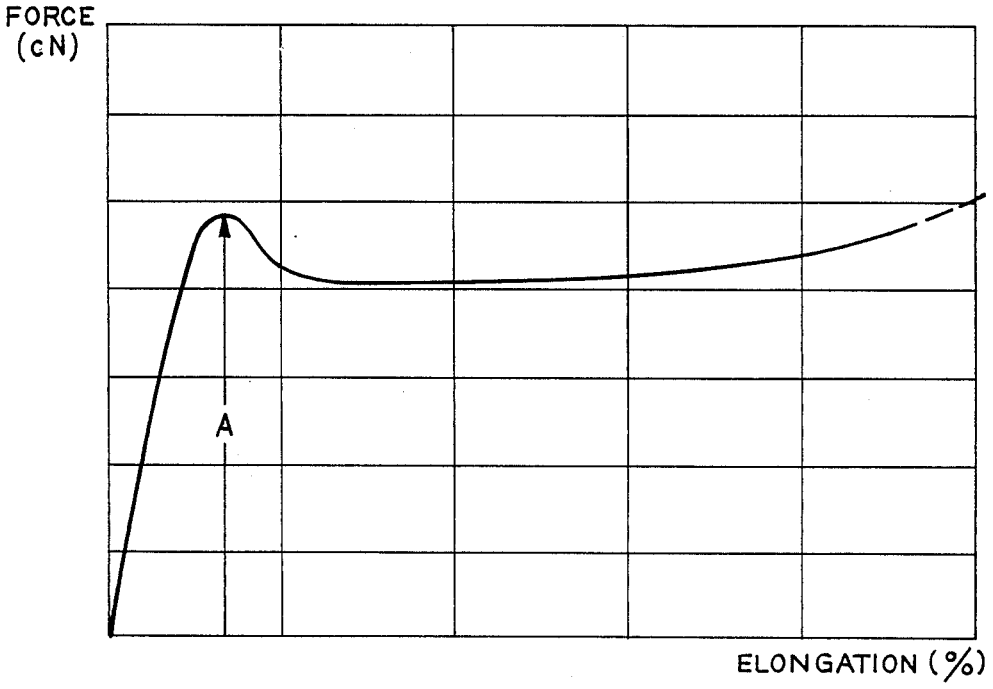

PROCESS FOR THE PRODUCTION OF UNIFORM POY FILAMENTS

BACKGROUND OF THE INVENTION

The invention relates to a melt spinning method for the production of pre-oriented, low-crystalline filaments (POY), which are distinguished by an especially high degree of uniformity. Mainly, the invention is concerned with the production of POY-filaments which are suitable for processing by means of friction-draw texturing at high speed, i.e., clearly in excess of 600 meters per minute.

THE PRIOR ART

Methods for the production of POY-filaments are already known and they are characteristic of melt spinning processes in which the filaments are withdrawn at high spinning speeds. For polyester filaments it is customary to employ the speeds in excess of 2750 meters per minute (m/min), thus achieving a degree of pre-orientation that is characterized by a birefringence of more than 0.025. The elongation-at-break of these filaments then is less than 180%. An upper limit of the spinning speed is imposed by orientation-induced crystallization. In the case of polyesters, this limit occurs at 4200 m/min.

Pre-oriented filaments, when drawn at high spinning speeds, are characterized by high thread tensions. Depending upon the spinning method, and also upon control of the thread-against-air friction to which the threads are exposed along the course from the cooling zone below the spinneret plate up to the infeed into the draw-off machine, thread tensions in excess of 0.3–0.5 cN/dtex may occur. On the other hand, winding thread tensions limited to between 0.05 and 0.3 cN/dtex are strived for, in the interest of optimal package formation.

At spinning speeds that are not too high, the tension requirements are fulfilled by draw-off machines that are withdrawing the filaments directly without rollers, followed by winding them to packages, in which case the draw-off speed is defined by the winding speed.

Such a method is, for example, described in U.S. Pat. No. 4,446,299 by Koschinek et al. However, when the operation is performed without rollers, it is not possible to intervene to regulate fiber vibrations and tension fluctuations, with the result that the filaments have average uniformity at best.

In other instances, two driven draw-off rollers, providing only single wrap-around contact, are utilized before the filaments are wound up.

Thus, the method of U.S. Pat. No. 4,517,149 of Oka et al. relates to the production of raw yarn for use in knitting and weaving, whereby a drawing treatment between two rollers is incorporated after the spinning, and the speed of the process is meant to be minimum 5000 m/min. The rollers are operated without heating.

Drawn yarns are involved here, in which case, with an increase of the draw-off speed to over 5000 m/min., lower draw ratios of up to 20% at most are employed. Any reference to subsequent treatment in the draw-texturing process is excluded from the outset.

If no stretching is employed (Oka et al., Table 4, Comparative Example 8), then between the two rollers there occur fiber vibrations, which lead to excessively increased fluctuations of the winding tension which are unfavorable. Insofar as the property of non-crystallinity is concerned, unacceptably high Uster values are obtained at speeds of 4000 m/min. It should be noted that the Uster values are unclear, because the mode of testing was not specified.

Furthermore, from U.S. Pat. No. 3,772,872 of Piazza et al. a method is known for the production of textured yarns, commencing from unstretched, oriented threads with low crystallization.

The spun threads are drawn off with a pair of high velocity rollers at speeds which give rise to specific mean characteristic values in the POY. Fluctuations of thread tension, their significance and their correlation with characteristic data and with the texturing performance are not described.

If statements are made with regard to texturing, they are based on a false-twist spindle process at a working speed of $\leqq 114$ m/min. There is no disclosure concerning a friction-disk process with speeds clearly above 600 m/min.

THE INVENTION

It is the object of the present invention to produce pre-oriented, low-crystalline synthetic filaments that are distinguished by a high degree of uniformity and by the ability to be worked at high speeds in a friction-draw texturing process into high-grade textured yarns.

According to the invention this object is attained by a method in which the damping ratio of the spinning thread between the point of solidfication and the winding unit is $<0.10$. The damping ratio is defined as the ratio of the fluctuation range of the filament tension at the beginning and at the end of the filament path. Interposed between the spinneret and the winding unit is a roller system comprising a driven roller and a freely rotating smaller roller in multiple wrap-around contact with the filaments.

The method according the invention is suitable for all polymers which are spinnable from a molten mass, such as polypropylene, polyamides, in particular PA-6, PA-6,6 and PA-4,6, copolyamides, polyesters, in particular polyethylene terephthalate and polybutylene terephthalate, and copolyesters.

In the case of polyesters, the filaments are produced in a draw-off range between 2400 m/min. and 4200 m/min. The speed at which the filaments are drawn from the driven roller is described as the draw-off speed. In practical terms, it corresponds to the circumferential speed of this roller. The speed of the coordinated additional small roller is determined by the friction of the filaments.

The use of multiple wrap-around contact excludes a stretching in the roller system. Likewise eliminated is any temperature treatment that would necessarily increase the crystallinity.

The speed difference of the driven roller in relation to the speed of the winding unit is adjusted in accordance with the prior art, with a view to uniform package winding and the tension between these two systems. In accordance with the invention, this tension should not be set too high in relation to the elasticity of the filaments, as denoted by the neck point tension (A) of the stress/strain curve which is represented by way of example in FIG. 3.

According to the invention, the filament-tension fluctuations are measured at selected points along the travel of the filament. A high-frequency resolution of approximately 120 Hz is important for the measurement device. The "Electronic Tensiometer" produced by the firm of Rothschild/Switzerland, model R-3192, and a model R-3094 high-speed recorder were utilized.

The point of solidification is considered to be that point at which the filament is cooled to such an extent that it does not stick to the measuring head of the tension measuring device. In this instance, the measured temperatures are below the second order transition temperature of the polymer.

The point of measurement immediately in front of the roller system is inside of the draw-off machine. The mean filament tension is increased by the thread-against-air friction and the friction from around thread guides along the travel of the thread.

As used herein, the words "before" and "after" are always employed with reference to the direction of movement of the filament. In the current state of the art, this direction denotes the effect of the filament tension on the uniformity features of the wound filaments.

According to the U.S. Pat. No. 4,517,149, when there is a high draw ratio between the rollers, lower filament tension fluctuations are maintained after the rollers, thus resulting in better thread properties.

With full recourse to the state of the art as it applies to draw-off systems, both in the absence of rollers and by means of a pair of rollers with diversely wrapped around contact, tension fluctuations of 13.5%–25.7% before the winding unit were obtained (Examples 1 and 2 below). Damping ratios over the entire filament travel equal 0.44 in the absence of rollers, and 0.16 for a meander-shaped wrapping around a pair of godets. The damping ratio of the roller system only was 0.27.

By the method according to the invention, with a quenching length of 700–1500 mm, with the spin finish application device being at a distance of 700–1500 mm from the spinneret plate, with a spinning length of 4400–6000 mm, defined as the distance between the spinneret plate and the point of infeed onto the rollers, and a roller system with driven roll and freely-rotating additional small rollers with 7 wraps of filament, the fluctuations of tension were measured as 39.6% before the winding unit, as 4.4% before the rollers, and as 2.0% at the point of solidification. The damping ratios were 0.11 with respect to the roller unit, and 0.051 with respect to the entire spinning course. The fluctuation of filament tension at the point of solidification (filament no longer sticky) preferably is no more than 2.6% and at a point between the roller system and the winding unit preferably is above 26%.

In evaluating the properties of the filaments, it appeared surprisingly that the filaments produced in accordance with the invention showed better Uster values than the prior art. The variation in mass of the wound filaments measured according to the Uster normal test is not more than 0.5% and the variation range preferably not more than 2%. After processing in texturing process a textured yarn was obtained even at high texturing speeds, which is characterized by an improved degree of dyeing uniformity.

It was surprising that, contrary to prior experience, with the high degree of tension fluctuations occurring before the winding unit, poor quality yarn did not result. It even appeared that, by varying the number of wraps around the roller system, the best properties were obtained in the yarn if the tension fluctuation before the winding unit was maximal. The number of wraps is not critical if at least three wraps are employed, preferably at least six.

This surprising result leads one to assume an inverse causality of the influence of the thread-tension fluctuations, with respect to the direction of filament movement.

Short-term fluctuations of tension originate on the basis of the traverse principle of the high-speed winding unit, and from vibrations of filaments in the roller system. These vibrations, in the direction of the filament movement, do not affect the quality of the filaments if the tension up to the winding unit is adjusted sufficiently low in the elastic tension range. However, the vibrations extending in the contrary direction of the filament path back into the plastic zone of filament forming below the spinneret plate, lead to periodic fluctuations of mass and structure during filament cooling at the frequency of the vibrations. Therefore, a tension apparatus of high-frequency resolution is a prerequisite for the effective discernibility of this mechanism. The damping ratio defined in accordance with the invention proved to be an index for the reflection of such interferences with the quality of the filament.

Conventional two-roller systems are characterized by damping ratios of between more than 0.25 and 0.30.

The roller system with additional small roller and multiple wrap-arrangement according to the invention has a maximum damping ratio of 0.19—which, in conformity with the usual facilities for filament guidance and travel, can be lowered to $<0.10$ for the entire length of filament travel.

BRIEF DESCRIPTION OF DRAWING

In the drawing

FIG. 1 is a schematic side view of a spinning and draw-off apparatus suitable for practising the method of this invention.

FIG. 2 is a schematic plan view of the set of rollers of FIG. 1 showing the wrapping of the filaments around the rollers.

FIG. 3 is a typical stress strain diagram for filaments prepared in accordance with the invention.

EXAMPLE I (Comparison)

Polyester chips having a viscosity of $\eta_{intr.}=0.65$ and a water content of 30 ppm were melted in an extruder and spun at a temperature of 298° C. A melt quantity of 10 of 26.2 g/min. was pressed through a 48-orifice spinneret plate 12 having an orifice diameter of 0.25 mm and cooled to solidification in a quench duct 14 with a horizontal, turbulence-free air flow of 19° C. and 85% relative humidity and a velocity of 0.45 m/sec. Thereafter, 0.35% spin finish, applied from an emulsion of 6% concentration, are applied to the filaments by a thread lubricator 16 at a distance of 700 mm from the spinneret plate. In the Zimmer-A model thread lubricator, the single filaments are bundled into a closed thread, minimizing the air-drag in the ensuing spinning shaft. From this point, the example differs from the invention. At a distance of 4400 mm below the spinneret plate, the thread is conveyed into a draw-off machine and is withdrawn without rollers and with the aid only of a high-speed winding unit 28 which includes guide means 26 with a speed of 3200 m/min. The filament titer of the wound POY was 82 dtex.

The measured tension ratios and damping ratios are shown below:

| | Point of Solidification | After Finish Application | Before Draw-Off | Before Winding |
|---|---|---|---|---|
| Thread tension (cN) | 7.6 | 10.0 | 12.5 | 13.5 |
| Tension fluctuation (%) | 6.0 | 6.2 | 13.0 | 13.5 |
| Damping ratio: | | | | |
| rollers | — | | | |
| entire | 0.44 | | | |

The Uster-uniformity of this yarn in the normal test was U%=0.7; Uster range=5.5%.

EXAMPLE II (Comparison)

Experimental procedure same as in Example I, with the difference that the draw-off machine was equipped with a pair of driven rollers, and that this pair was surrounded by 2 single 180° wraps of filament.

Tension ratios:

| | Point of Solidification | After Finish Application | Before Rollers | Before Winding |
|---|---|---|---|---|
| Thread tension (cN) | 7.8 | 10.2 | 13.6 | 10.2 |
| Tension fluctuation (%) | 4.0 | 4.3 | 6.9 | 25.7 |
| Damping ratio: | | | | |
| rollers | 0.27 | | | |
| entire | 0.16 | | | |

The Uster-uniformity of this yarn in the normal test was U%=0.65; Uster range=4.5%, and did not differ significantly from the 1st Example.

EXAMPLE III (Invention)

Experimental procedure same as in Example I, with the difference that the draw-off machine 20 comprises one driven roller 22 of 150 mm diameter and one additional small roller with air bearing 24 of 35 mm diameter, and winding unit 28. The roller system was wrapped around 7 times with filaments as best shown in FIG. 2. The draw-off speed of the driven roller was 4% higher than that of the winding unit 28.

Tension ratios:

| | Point of Solidification | After Finish Application | Before Rollers | Before Winding |
|---|---|---|---|---|
| Thread tension (cN) | 7.5 | 10.0 | 14.0 | 9.5 |
| Tension fluctuation (%) | 2.0 | 2.6 | 4.4 | 39.6 |
| Damping ratio: | | | | |
| rollers | 0.11 | | | |
| entire | 0.051 | | | |

The Uster-uniformity of this yarn in the normal test was U%=0.4; Uster range=2.5%, and was clearly better than in Examples I and II for Comparison.

EXAMPLE IV (Invention)

The apparatus of this example is not illustrated. Polyester chips with a viscosity of $\eta_{intr.}=0.65$ and with a water content of 18 ppm were molten in an extruder and spun at a temperature of 295° C. A melt quantity of 86.8 g/min. was pressed through a 34-orifice spinneret plate with an orifice diameter of 0.25 mm. Eight spinneret plates were disposed in the spinning unit. The filaments from the 8 spinnerets were cooled and solidified in a quenching duct with a horizontal, turbulence-free air flow moving at a speed of 0.55 m/sec. Thereafter, at a distance of 1200 mm from the spinneret plate, 0.40% spin finish, applied from an emulsion of 12% concentration, are applied to the filaments. In the Zimmer-B model thread lubricator, the single filaments of each spinneret plate are bundled and collected into 8 closed threads, minimising the air-drag in the ensuing spinning shaft.

At a distance of 6000 mm below the spinneret plate, the threads were conveyed into tthe draw-off machine which was equipped with two sets of rollers, each of which contains a driven roller of 150 mm diameter and an additional smaller roller of 35 mm diameter with air bearing. Each four threads were drawn-off by one roller set, while the rollers were wrapped around 7 times. Each four threads were wound in a separate winding unit. The speed of the driven rollers was 3208 m/min; that of the winding unit was 3195 m/min.

Tension ratios:

| | Point of Solidification | After Finish Application | Before Rollers | Before Winding |
|---|---|---|---|---|
| Thread tension (cN) | 16 | 18 | 25 | 20 |
| Tension fluctuation (%) | 1.5 | 2.5 | 5 | 44 |
| Damping ratio: | | | | |
| rollers | 0.11 | | | |
| entire | 0.034 | | | |

The Uster-uniformity of this yarn in the normal test was U%=0.30, Uster-range=1.5%, which signified an outstanding uniformity. These filaments were friction-draw textured at a speed of 850 m/min., during which a draw-ratio of 1:1.74 was employed. No capillary breaks and tight spots were found in the textured yarn over a length of 5 km. The uniformity of dyeability was excellent.

We claim:

1. A method for the production of pre-oriented low crystalline, synthetic filaments characterized by a high degree of uniformity and ability to be worked at high speeds in a friction-draw texturing process, comprising:

spinning the filaments from a molten polymer mass;

solidifying and applying a spin finish to said filaments;

passing said filaments along a filament path into a draw-off machine having a system of rollers and a winding unit;

said system of rollers comprising a driven roller and a freely-rotating smaller roller around which rollers the filaments are wrapped more than one time;

the mean filament tension between said rollers and said winding unit being equal to or less than one-half the yield point tension of a stress-strain curve for said filaments;

whereby the number of wraps is selected to produce a damping ratio of the fluctuation in tension of the filament between the point of solidification and said winding unit of less than 0.10;

said damping ratio being defined as the ratio of the fluctuation range of the filament tension at the beginning and at the end of said filament path.

2. A method according to claim 1, characterized in that the damping ratio of the roller system is not more than 0.19 and that said filament path extends from before said rollers to after said rollers.

3. A method according to claim 1, characterized in that the number of wraps of the filaments around the said driven and freely-rotating rollers is sufficiently high to produce a minimal damping ratio.

4. A method according to claim 1, characterized in that said fluctuation of filament tension at the point of solidification corresponding to a position at which the filament is no longer sticky is not more than 2.6 percent.

5. A method according to claim 1, characterized in that the fluctuation of filament tension between said roller system and said winding unit is at least 26 percent.

6. A method according to claim 1, characterized in that the variation in mass of the wound filaments, when measured according to the Uster normal test, is not more than 0.5 U% and the variation range not more than 2 percent.

7. A method according to claim 3 in which said number of wraps equals 7.

* * * * *